United States Patent [19]

Espinosa

[11] 4,262,649

[45] Apr. 21, 1981

[54] SINE BI-ANGLE WHEEL DRESSER

[76] Inventor: Fidel Espinosa, 1155 W. 77 St., Apt. 125D, Hialeah, Fla. 33014

[21] Appl. No.: 103,974

[22] Filed: Dec. 17, 1979

[51] Int. Cl.[3] ..... B24B 53/02

[52] U.S. Cl. ..... 125/11 B

[58] Field of Search ..... 125/11 R, 11 B, 11 T, 125/11 GA

[56] References Cited

U.S. PATENT DOCUMENTS

| | | | |
|---|---|---|---|
| 2,378,743 | 6/1945 | Wisne | 125/11 B |
| 2,425,453 | 8/1947 | Bauosi | 125/11 B |
| 2,446,562 | 8/1948 | Trbojevich | 125/11 T |
| 2,456,061 | 12/1948 | Hohwart | 125/11 B |
| 2,614,552 | 10/1952 | Griffin | 125/11 AT |
| 2,733,702 | 2/1956 | Barrett | 125/11 B |
| 2,771,821 | 11/1956 | Beusch | 51/DIG. 31 |

FOREIGN PATENT DOCUMENTS

| | | | |
|---|---|---|---|
| 1106412 | 12/1955 | France | 125/11 B |

*Primary Examiner*—Harold D. Whitehead
*Attorney, Agent, or Firm*—Jesus Sanchelima

[57] ABSTRACT

A sine bi-angle wheel dresser capable of accurately dressing a surface grinder's wheel on both sides without disturbing the initial set-up on the magnetic table. The dresser comprises a base which supports a carrier holder having the shape of an isosceles triangle and two bushings on the hypotenuse side, a pin inserted through pivot holes in said base and said bushing thereby allowing the carrier to rotate about one of the bushings and held in place when gage blocks are placed between the moving bushing and the base, and a carrier slidably mounted on one of the two similar sides of the triangular holder.

3 Claims, 7 Drawing Figures

SINE BI-ANGLE WHEEL DRESSER

BACKGROUND OF THE INVENTION

1. Field of the Invention

This invention relates to wheel dressers for surface grinders, and more particularly, to sine bi-angle wheel dressers capable of dressing both side surfaces of a wheel without disturbing the initial set-up.

2. Description of the Prior Art

Grinding wheel dressing tools described in the prior art are many in number and varied in structure, ranging from small hand tools to highly complex and expensive motor-driven radius and tangential forming mechanisms embodied as an integral component of a grinding machine.

In general, the hand-operated prior art angle wheel dressers require several mechanical operations to adjust the tool to effect more than a single angle cut on a wheel.

None of the patented dressers come close to the present invention. The closest reference being described in a sales brochure published by American Standard Company, Plantsville, Connecticut, which offers for sale a sine angle wheel dresser. The brochure gives notice that a patent has been applied for. However, this device requires the user to set it up for each side of the wheel, thereby causing inaccuracies and waste of time.

The methods used at the present time for dressing wheels rely primarily on the user's skills and the referencing is done by bringing the cutting diamond close enough to the wheel as to make contact which is detected by the acute noise produced by the wheel. The present invention eliminates the guess work and provides a tool for accurately dressing wheels.

SUMMARY OF THE INVENTION

It is an object of the present invention to provide a new tool that eliminates the necessity of costly special equipment, such as radius dressers and magnetic sine planes for dressing the wheels of surface grinders to required accurate angles.

It is another object of the present invention to minimize the set-up time spent when dressing the wheels of surface grinders.

It is still another object of this invention to assure the user maximum accuracy in finding his dimensions relative to the side surfaces of the wheels of surface grinders.

It is yet another object of the present invention to provide an inexpensive tool for dressing the wheels of surface grinders, without sacrificing precision.

The invention also comprises such other objects, advantages and capabilities as will later more fully appear and which are inherently possessed by the invention.

DESCRIPTION OF THE DRAWINGS

With the above and other related objects in view, this invention consists in the details of construction and combination of parts as will be more fully understood from the following description, when read in conjunction with the accompanying drawings, in which.

DETAILED DESCRIPTION OF THE PREFERRED EMBODIMENT

Figure 1:
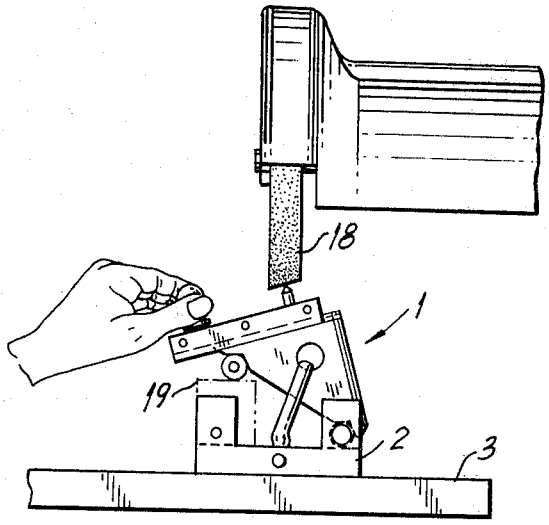
FIG. 1 shows the present invention dressing a wheel of a grinder machine.
Figure 2:
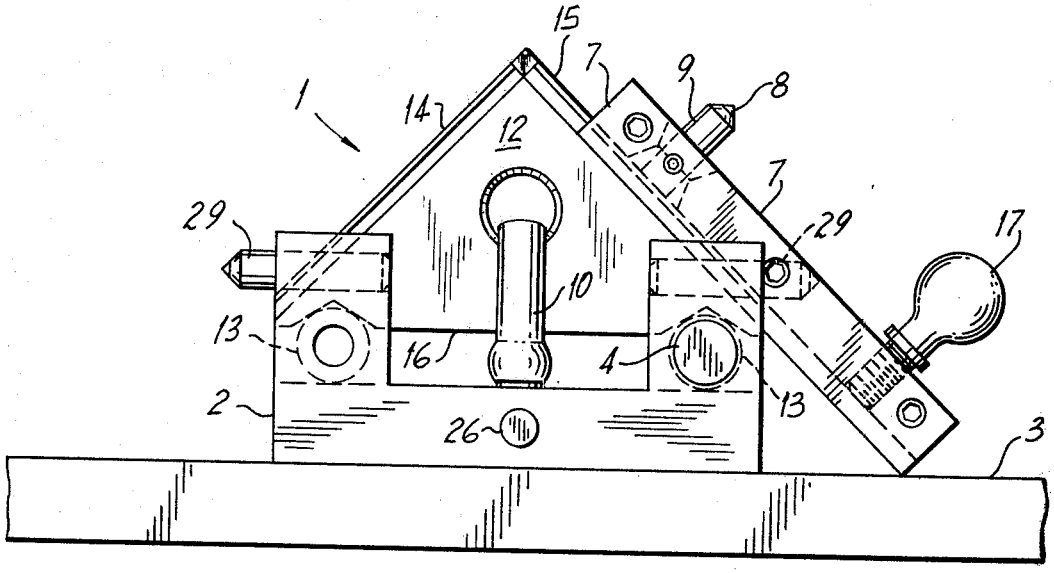
FIG. 2 is a front view of the sine bi-angle wheel dresser.
Figure 3:
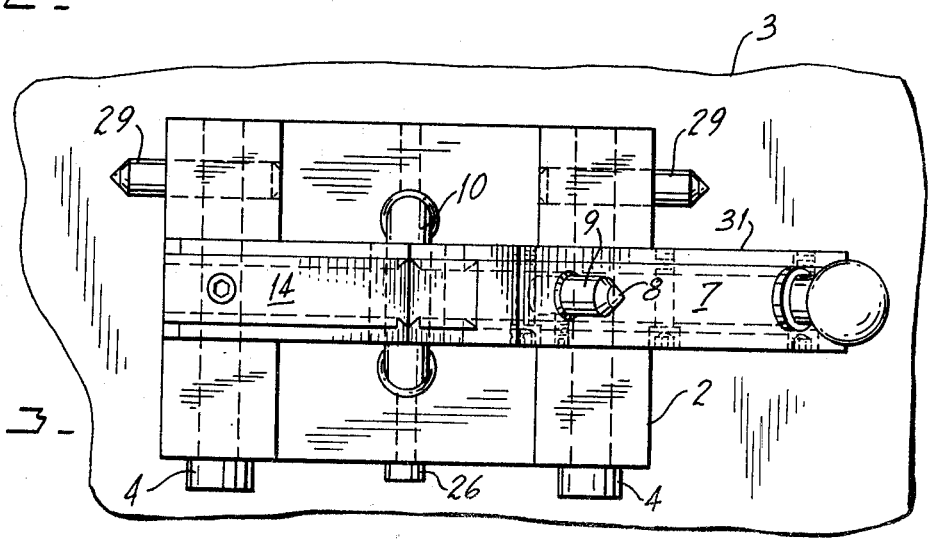
FIG. 3 is a top view of the device.
Figures 6, 6A:
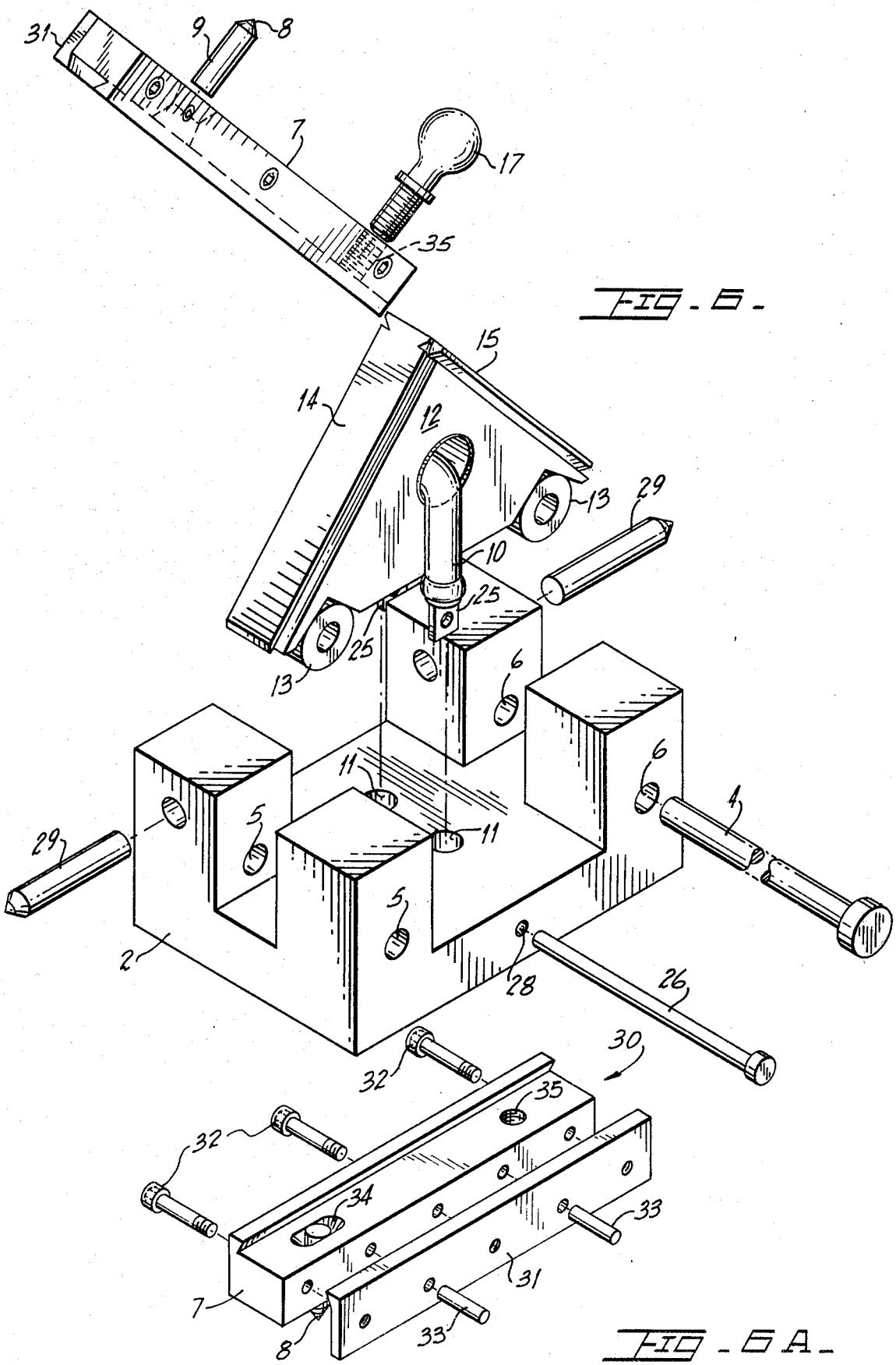
FIG. 6 is an exploded view of the device showing its different parts.
FIG. 6A shows the carrier, disassembled, in order to appreciate some of its construction details.

Referring to the drawings wherein like reference characters designate like or corresponding parts throughout the several views, the device is generally designated by the number 1. It is seen in FIG. 1 to include a base 2 which mounts on a magnetic table 3 of the type used in conjunction with surface grinders. Referring now to FIG. 6, where there are two pairs of pivot holes 5 and 6, designated as left and right pivot holes respectively, which are formed on vertical support members 27 integrally built in said base 2. Housed longitudinally between said pivot holes 5 and 6 is carrier holder 12 which has the shape of an isosceles triangle. The side 16 of the carrier holder 12 corresponds to the hypotenuse and has two bushings 13. Pin 4 is inserted through one of said bushings 13 and through either left pivot holes 5 or right pivot holes 6, depending upon which one of the two corners formed with the hypotenuse side 16 of the carrier holder 12 will be held stationary. To secure carrier holder 12 further, a rubber band 10 is removably attached to the base 2 and inserted through holes 11 of the carrier holder 12. The ends of rubber band 10 have terminations 25 provided with a hole that allows engagement with rubber band securing pin 26 as shown in FIG. 3.

An elongated carrier 7 slidably and removably mounts on either side 14 or 15, which are of the same size and their planes are at 45° with respect to hypotenuse side 16. Carrier 7 has a handle 17 that allows the user to slide it during the grinding operation. A cutting diamond 8 is secured in place by diamond holder 9 which in turn is attached towards one end of said carrier 7.

As shown in FIG. 6A, the carrier 7 may be disassmbled in substantially two members: the carrier main body 30 and its complementing guide 31. These two members are held together by a plurality of Allen cap screws 32 and securing pins 33 inserted through said two members thereby preventing any relative movement. The main body 30 has a cavity 34 for the diamond holder towards one end and a threaded hole 35 for handle 17 on the other end.

OPERATION

Figure 4:
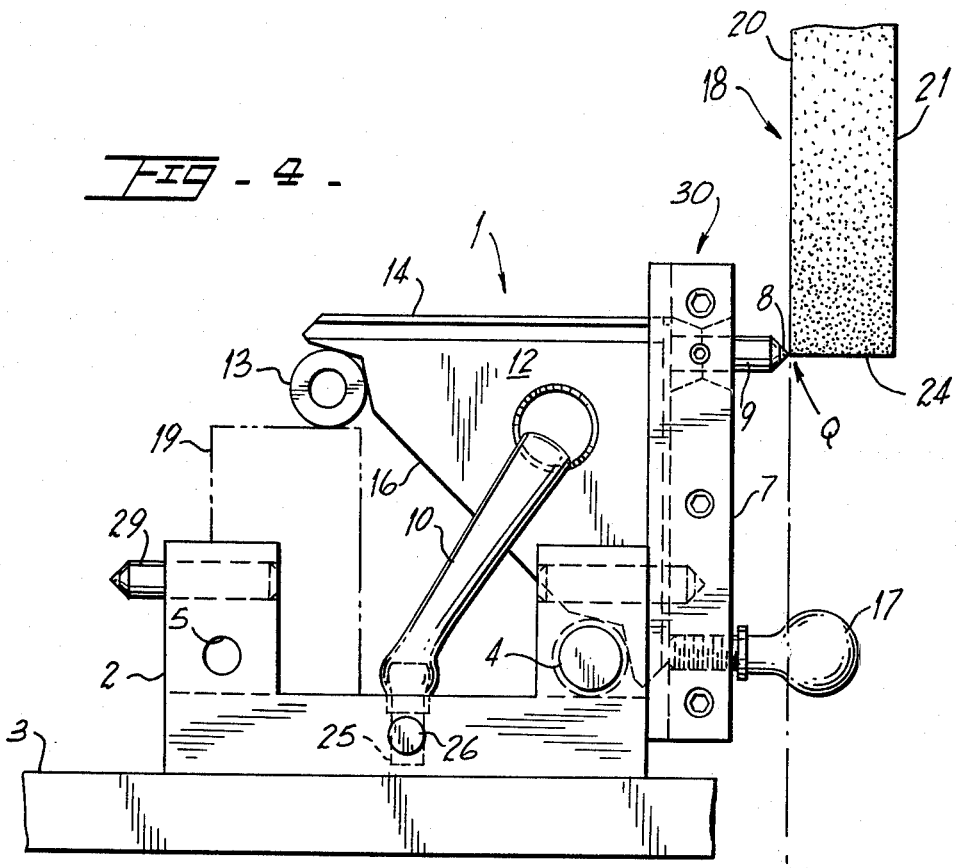
FIG. 4 illustrates the dresser when it is being referenced to a zero point with respect to one of the surfaces of the wheel.
Figure 5:
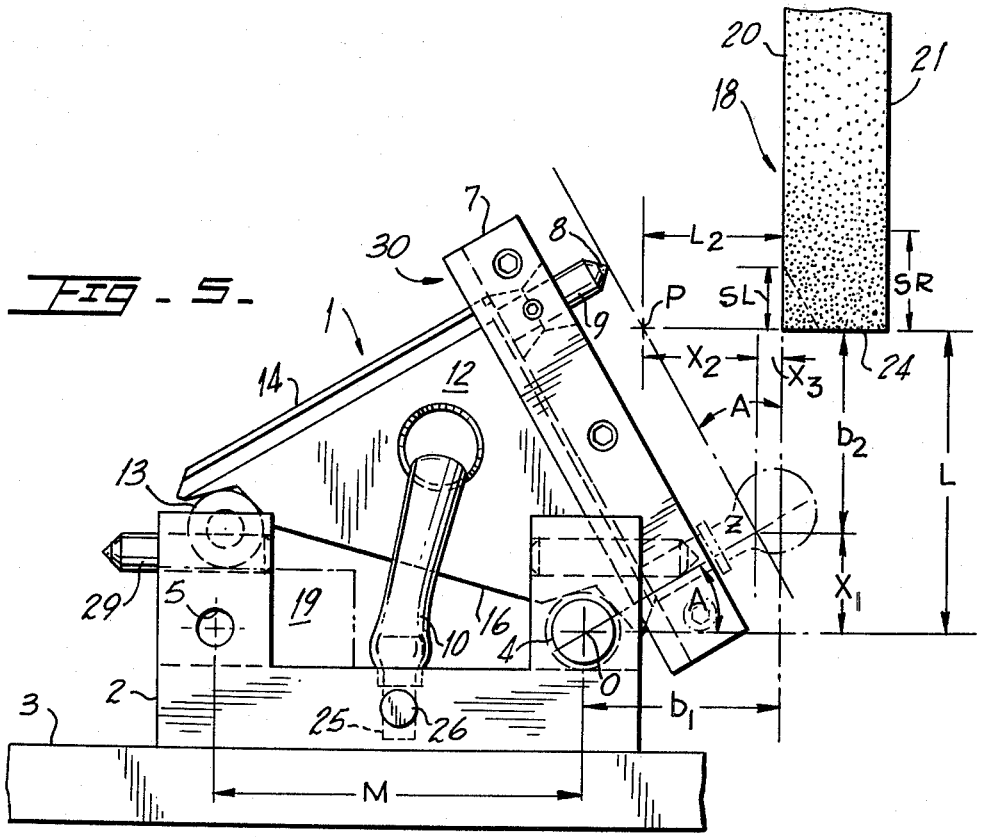
FIG. 5 shows the different variable and constant dimensions of interest.

First, the user sets the bi-angle wheel dresser 1 on the magnetic table 3, next to the grinding wheel 18, on the left side surface 20 of the grinding wheel to be dressed, as shown in FIG. 4. A 90° gage block 19 is placed below left bushing 13 so that carrier 7, and consequently, cutting diamond 8, can be slid up and down parallel to the side surface 20 of wheel 18. The dresser 1 is then brought closer to the wheel 18 until it barely touches it. The point Q will be the reference zero for lateral movement. Next, the gage block 19 is taken out and pin 4 is also taken out of right pivot holes 6 and inserted through left pivot holes 5 and the corresponding bushing 13 on the carrier holder 12. Carrier 7 is taken out of the right side 15 of holder 12. Magnetic table 3 is then moved to the right from the reference point Q for lateral movement and inserted on left side 14. The 90° gage block 19 is now placed below the right pivot 6 allowing the diamond 8 to slide parallel to the wheel's right side 21, barely touching the wheel 18, when the magnetic table 3, and consequently base 2, is transported a certain displacement distance to the left. Finally, the carrier 7 is placed back on carrier holder's 12 right side 15 and the dresser 1 is positioned so that the wheel's bottom line 24 barely touches the cutting diamond 8 which now slides parallel to said bottom line 24, defining thereby distance L, refer to FIG. 5. Now, the user is ready to dress the wheel 18 with a certain angle. For illustration purposes, let us assume that a 10° angle with respect to the vertical plane or the wheel's right surface 21 is desired and starting at a distance SR from the bottom line. On the wheel's left surface 20, we want a 30° angle with respect to the vertical plane, starting at a distance SL above the bottom line 24. Referring to FIG. 5, since we know $b_1$ which is a constant distance between the center of the right bushing 13 and the point Z which is defined by the intersection of the line projected by the tip of the diamond 8 and a perpendicular line 0-Z that passes through the center "O" of said right bushing 13. In FIG. 4, it can be seen that point Z falls on the line projection of diamond 8, when the carrier 7 is in the vertical position. In the preferred embodiment, $b_1$ equals 1.250 inches. To facilitate this illustration, let us start with the dressing of the left surface 20, referring to FIG. 5, even though a trained user would probably start with right surface 21 since that is where the wheel 18 was. Therefore, the base 2 is brought back to reference zero and we want to have an angle of 30° on the wheel's left surface 20. Aside from $b_1$, we know that L is a constant, in the preferred embodiment L equals 2.768 inches.

Identifying now the desired angle A, which is 30° for the left surface of the wheel, with the angle formed between the projection of the path of diamond 8 as the carrier slides up and down with a vertical plane, and the corresponding angle formed by perpendicular line O-Z and the horizontal plane. Next, we proceed to compute the distance $X_1$ equals $b_1$ times sine of A (or30°). Then $b_2$ equals L minus $X_1$. Once $b_2$ is known, $X_2$ may be computed by multiplying $b_2$ times tangent of A. Then $X_3$ equals $b_1$ minus $b_1$ times Cos A. Finally, $L_2$ (the distance from point P to the left surface of the grinding wheel) is $X_2$ plus $X_3$, or $b_2$ times tangent of A plus $b_1$ minus $b_1$ times Cosine of A. If L, b, and A are constants, then;

$X_1 = b_1 \cdot \text{Sin } A$ 1

$b_2 = L - X_1$ 2

$X_2 = b_2 \cdot \text{Tan } A$ 3

$X_3 = b_1 - b_1 \cdot \text{Cos } A$ 4 $L_2 = X_2 + X_3$ $L_2 = b_2 \cdot \text{Tan } A + b_1 - b_1 \cdot \text{Cos } A$ 5

In the present example:

$L = 2.768$ $b_1 = 1.250$ $A = 30°$, Sin 30° − 0.500: tan 30° = 0.577; Cos 30° = 0.866

From equation #1, $X_1 = (1.250)\ (0.500)$ $X_1 = 0.625$

Using equation #2

$b_2 = 2.768 - 0.625 = 2.143$ Substituting in #3

$X_2 = (2.143)\ (0.577) = 1.237$ $X_3 = 1.250\ (1 - 0.866) = 0.168$ $L_2 = 1.237 + 0.168 = 1.405$

Now we know that the table 3 will have to be moved to the right 1.405 inches for the projection line of the diamond 8 to touch point Q. The user will now compute in the usual way how far he will have to grind the wheel to provide the desired angle in the usual way.

A similar procedure is followed for the dressing of a 10° angle on the right surface of the wheel, substituting 10° for the 30° used in the previous computations.

It is believed the foregoing description conveys the best understanding of the objects and advantages of the present invention. Different embodiments may be made of the invention herein described without departing from the inventive concept of this invention. It is to be understood that all matter disclosed herein is to be interpreted merely as illustrative, and not in a limiting sense, except as set forth in the following appended claims.

What I claim is:

1. A sine bi-angle wheel dresser capable of accurately providing the wheels of surface grinders with an angle on each side without disturbing its initial set-up, comprising:

(a) a base of substantially rectangular shape having a vertical support member on each corner and each support member having a pivot hole therethrough, said pivot holes being aligned and arranged in pairs on each end of said base, (b) a carrier holder having the shape of an isosceles triangle including two bushings on the longer side of said holder, said bushings being separated and each in alignment with a pair of said pivot holes when said carrier is sandwiched between said vertical support members, said carrier holder including symmetrical guide means on each of the shorter side thereof, said guides being aligned with each other, (c) a pin extending through one of said pair of pivot holes and a brushing and having a diameter that makes it fit snugly, (d) a carrier of elongated rectangular shape removably and slidably engaging said guide or means on either one of the symmetrical sides in said triangular holder and further including a cutting diamond attached to a diamond holder which in turn is attached to one end of said carrier and the other end having a handle integrally built in said carrier, and (e) means for urging said carrier towards said base

2. The dresser set forth in claim 1 wherein said base has a lateral hole towards the middle of said base that connects with two vertical holes positioned on each side of said carrier and said means for urging said carrier towards said base comprises a rubber band with hollow terminations and a rubber band securing pin removably inserted through said laterial hole and said hollow terminations thereby securing said rubber band in place which in turn urges said carrier holder towards the base.

3. The dresser set forth in claim 2 wherein said carrier has a threaded hole and said handle has a screw termination mating with said threaded hole allowing said termination to protrude through said carrier and to make pressure contact against said holder thereby preventing relative movement of said carrier with respect to said holder.

* * * * *